United States Patent [19]

Meadows

[11] 4,191,888

[45] Mar. 4, 1980

[54] SELF-SHIELDING SMALL HOLE ACCEL GRID

[75] Inventor: George A. Meadows, Bethesda, Md.

[73] Assignee: Communications Satellite Corporation, Washington, D.C.

[21] Appl. No.: 961,828

[22] Filed: Nov. 17, 1978

[51] Int. Cl.[2] ..... G21K 1/08

[52] U.S. Cl. ..... 250/396 R; 60/202; 250/423 R; 313/360

[58] Field of Search ..... 250/423 R; 60/202; 313/359, 360

[56] References Cited

U.S. PATENT DOCUMENTS

| | | | |
|---|---|---|---|
| 2,956,169 | 10/1960 | King et al. | 313/361 |
| 3,137,801 | 6/1964 | Brooks et al. | 313/361 |
| 3,304,718 | 2/1967 | Webb | 60/202 |
| 4,135,094 | 1/1979 | Hull | 250/423 R |

*Primary Examiner*—Harold A. Dixon

*Attorney, Agent, or Firm*—Sughrue, Rothwell, Mion, Zinn and Macpeak

[57] ABSTRACT

An ion extraction system utilizing small hole accel grid (SHAG) optics is disclosed. A screen grid, an accel grid and a decel grid are positioned downstream of a neutral, highly ionized plasma source, and each of these grids have apertures in axial alignment. The accel grid has a relatively small aperture in the range of less than 50% to approximately 10% the size of the aperture of the screen grid. The electric field set up by the screen grid and the accel grid serve to extract an ion beam from the plasma source and focus the ion beam through the accel grid aperture. The small aperture in the accel grid is formed by drilling a relatively large aperture in the accel grid and then securing a thin metallic foil on at least the downstream face of the accel grid to cover the large, drilled aperture.The relatively small aperture is etched in the thin metallic foil by the ion beam.

4 Claims, 2 Drawing Figures

SELF-SHIELDING SMALL HOLE ACCEL GRID

BACKGROUND OF THE INVENTION

The present invention generally relates to an ion extraction system for devices utilizing grids to accelerate and focus ion beams, such as ion thrusters and ion sources. More particularly, this invention utilizes small hole accel grid (SHAG) optics, which minimizes the emission of neutral atoms with a three-electrode system and allows high ion extraction current densities at low net extraction voltages. A particular feature of the invention is the construction of the accel grid that has the advantages of reducing the contamination of surfaces downstream of the electrode system through accel grid sputtering and is easier to fabricate and use than a conventional SHAG electrode.

Present ion extraction systems use two or three electrode systems with either standard hole accel grids, having an open area approximately 50% that of the aperture of the screen grid, or small hole accel grids, having an open area as low as 10% of the aperture of the screen grid. In the latter case, the hole sizes are slightly larger than the individual ion beamlets. The state-of-the-art system utilizes small hole accel grid (SHAG) optics with a three-electrode system comprising a screen grid, the accel grid and a decel grid. A neutral highly ionized plasma upstream of the electrodes is typically held at a high positive voltage of several hundred to several thousand volts. On the other hand, the accel grid is held at a negative voltage of several hundred to several thousand volts, while the decel grid is held at zero or ground potential. The electric field set up by the screen grid and the accel grid extracts an ion beam from the plasma source and focuses it through the accel grid hole. The function of the decel grid is to minimize the beam spread or divergence after the ion beam passes through the accel grid. The small aperture size of the accel grid minimizes the emission of the un-ionized atoms from the discharge plasma, which in ion thrusters maximizes the thruster performance, and in ion sources minimizes the propellant gas flow, thus minimizing the vacuum system pressure.

One disadvantage of this electrode system is the possibility of contamination by sputtered accel grid material. As the ion beam passes through the accel grid aperture, charge-exchange between the high energy ions and the neutral atoms drifting through the aperture can occur, producing a low energy ion which strikes the accel grid. In a three-electrode system, these charge-exchange ions strike and sputter the grid on the barrels of the holes. Although most of the sputtered grid material will be contained within the grids and discharge chamber, some of the material is emitted and can coat surfaces downstream of the grids. Another shortcoming of the electrode system is the difficulty in making the SHAG electrodes. The usual method has been to use a blank plate at the accel grid and let the ion beamlets etch each hole. This process is fairly tedious and can take 24 hours or longer with fairly thick accel electrodes. If the electrode assembly is disassembled and reassembled, perfect realignment is practically impossible so that the electrode system will have to be operated for a time before the ion impingement on the accel grid is reduced to a negligible value.

SUMMARY OF THE INVENTION

The present invention overcomes both of the deficiencies over the prior art electrode system described above. According to the invention, the accel grid has a large, drilled aperture, typically of a diameter on the order of 2.083 mm. A thin foil, for example, tantalum of a thickness of 0.0127 mm is placed on at least the downstream face of the accel grid and covers the large, drilled aperture. In the preferred embodiment, a second very thin metallic foil is also placed on the upstream face of the accel grid covering the large, drilled hole. With this construction, the ion beam etches only through the thin foils so that the etching time is much shorter than for a solid plate, sometimes less than an hour with very thin foils. Sputtered acceleration grid material contamination is substantially reduced because the doughnut-shaped volume defined by the interior foil surfaces and the barrel of the drilled hole traps much of the sputtered material. If the electrode system is disassembled and reassembled, the run-in time before direct accel grid impingement disappears is much less than for a solid plate SHAG electrode because only the thin foils have to be etched.

BRIEF DESCRIPTION OF THE DRAWINGS

The objects, advantages and features of the invention are set forth in more particularity in the following detailed description which makes reference to the attached drawings, in which.

DETAILED DESCRIPTION OF THE INNVENTION

Figure 1:
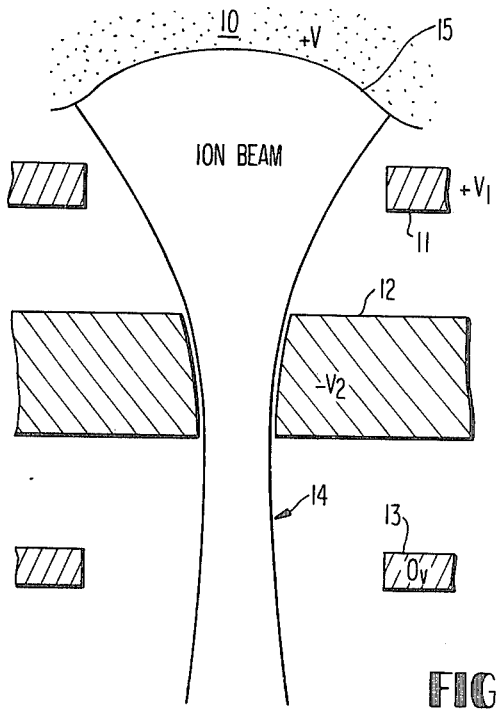
FIG 1 PRIOR ART
FIG. 1 is a cross-sectional view of a prior art three-electrode system typically used in a state-of-the-art ion extraction system.

Referring first to FIG. 1 which shows the prior art three-electrode system, a neutral highly ionized plasma 10 upstream of the electrodes is contained within a discharge chamber (not shown) and held at $+V_1$ volts, usually several hundred to several thousand volts. The three electrodes downstream of the plasma source each have apertures in axial alignment and include in the following order a screen grid 11, an accel grid 12 and a decel grid 13. The screen grid 11 is also held at $+V_1$ volts, but the accel grid 12 is held at $-V_2$ volts, also several hundred to several thousand volts. Thus, an electric field is set up by the screen grid 11 and the accel grid 12 which extracts an ion beam 14 from the plasma boundary 15 and focuses it through the accel grid hole. The third or decel grid 13 is held at zero volts or ground potential and minimizes the beam spread or divergence after the ion beam passes through the accel grid hole. The accel grid has a relatively small aperture in the range of less than 50% to approximately 10% the size of the aperture of the screen grid. As previously mentioned, the small aperture size of the accel grid minimizes the emission of the un-ionized atoms from the discharge plasma.

Figure 2:
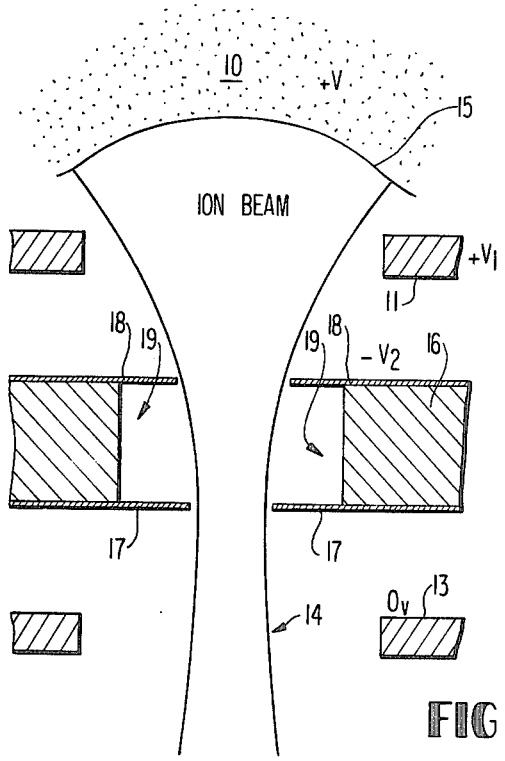
FIG. 2 is a cross-sectional view of the three-electrode system using the self-shielding SHAG accel grid according to the present invention.

Now with reference to FIG. 2 wherein the same reference numerals as used in FIG. 1 designate identical parts, the present invention utilizes the same three-electrode system as before except that the accel grid 16 has a relatively large drilled accel grid hole, on the order of 2.083 mm diameter in a preferred working embodiment.

Thin foils 17 and 18 are secured to both faces of the accel grid 16 so as to cover the large, drilled hole. In a preferred embodiment, the foil used was 0.0127 mm thick tantalum spot welded on a 0.79 mm thick accel electrode. The ion beam 14 etches only through the thin foils 17 and 18 so that the etching time is much shorter than for a solid plate. For the example described, the holes were etched in approximately 1½ hours with a total extraction voltage of one thousand volts ($V_1 = +500$ volts, $V_2 = -500$ volts) at a 2 mA/cm$^2$ ion current density (argon ions). It will, of course, be appreciated that the foregoing example represents but one combination of extraction voltage and current density. A larger aperture will be generated by lower voltage and/or higher current density, and a smaller aperture generated by a higher voltage and/or lower current density.

As can be clearly seen in FIG. 2, with the accel grid sputter site 19 being the doughnut-shaped volume defined by the interior surfaces of the foils 17 and 18 and the barrel of the drilled hole, the foils 17 and 18 act as a sputter shield, thereby preventing much of the emission of sputtered grid accel material that would normally occur with the prior art three-electrode system shown in FIG. 1. If the electrode system shown in FIG. 2 is disassembled and reassembled, the run-in time before direct accel impingement disappears is much less than that for the solid plate SHAG electrode 12 shown in FIG. 1 because only the foils 17 and 18 have to be etched.

A simple modification of the inventon shown in FIG. 2 is to fabricate the accel grid with only the foil 17 on the downstream face. This modification has little effect on the ion optics and shortens even further the milling time required to generate the accel grid aperture.

An alternative fabrication technique employing plating and etching processes can be used to make the accel grid. Specifically, a thin layer of nickel is first plated over a solid copper accel electrode. The thin nickel plate is ion beam etched to provide the small aperture on the upstream side of the accel grid. Using the ion beam-etched nickel as a mask, the copper is chemically etched to form the interior volume of the grid and expose the nickel on the downstream surface of the accel grid. The nickel plate is then etched by the ion beam to form the downstream small aperture. The nickel plate forms the foil attached to the faces of the accel grid, and the copper forms the body of the grid with the large hole apertures.

What is claimed is:

1. In an ion extraction system utilizing small hole accel grid optics and comprising within a discharge chamber a neutral highly ionized plasma source at a first voltage $V_1$, $V_1$ being positive, a plurality of electrodes downstream of said plasma source each having apertures in axial alignment and including in the following order a screen grid at said first voltage $V_1$ and an accel grid at a second voltage $V_2$, $V_2$ being negative, said accel grid having a relatively small aperture in the range of less than 50% to approximately 10% the size of the aperture of said screen grid, the electric field set up by said screen grid and said accel grid serving to extract an ion beam from the plasma source and focus the ion beam through the accel grid aperture, the improvement wherein said accel grid is provided with a relatively large aperture and a metallic foil on at least the downstream face thereof covering said large aperture, said relatively small aperture being etched in the metallic foil by the ion beam.

2. The improved accel grid structure recited in claim 1 further comprising a metallic foil on the upstream face of the accel grid and covering said large aperture, a relatively small aperture also being etched in the metallic foil on the upstream face by the ion beam.

3. The improved accel grid structure recited in claims 1 or 2 wherein the metallic foil is a thin foil of tantalum.

4. The improved accel grid structure recited in claim 1 wherein the accel grid is copper and the metallic foil is nickel.

* * * * *